US005486902A

United States Patent [19]

Ito

[11] Patent Number: 5,486,902

[45] Date of Patent: Jan. 23, 1996

[54] COLOR IMAGE FORMING APPARATUS FOR FORMING COLOR IMAGE BY TRANSFERRING COLOR TONER TO TRANSFER MATERIAL

[75] Inventor: Akira Ito, Tokyo, Japan

[73] Assignee: Canon Kabushiki Kaisha, Tokyo, Japan

[21] Appl. No.: 200,691

[22] Filed: Feb. 23, 1994

[30] Foreign Application Priority Data

Feb. 24, 1993 [JP] Japan ..... 5-059750

[51] Int. Cl.[6] ..... G03G 15/08

[52] U.S. Cl. ..... 355/208; 355/228; 355/271; 355/326 R

[58] Field of Search ..... 355/326 R, 327, 355/228, 274, 271, 211, 208

[56] References Cited

U.S. PATENT DOCUMENTS

| | | | |
|---|---|---|---|
| 4,772,916 | 9/1988 | Mochida . | |
| 4,851,960 | 7/1989 | Nakamura et al. . | |
| 4,888,621 | 12/1989 | Ohno | 355/326 R |
| 4,912,515 | 3/1990 | Amemiya et al. | 355/274 |
| 5,132,736 | 7/1992 | Muramatsu et al. | 355/271 |
| 5,683,167 | 1/1992 | Fukushima et al. | 355/274 |

FOREIGN PATENT DOCUMENTS

| | | |
|---|---|---|
| 60-113264 | 6/1985 | Japan . |
| 63-149669 | 6/1988 | Japan . |
| 1-142582 | 6/1989 | Japan . |
| WO91-19229 | 12/1991 | WIPO . |

*Primary Examiner*—A. T. Grimley
*Assistant Examiner*—T. A. Dang
*Attorney, Agent, or Firm*—Fitzpatrick, Cella, Harper & Scinto

[57] ABSTRACT

The present invention relates to an apparatus for forming color toner images on an electrophotographic photosensitive member and for transferring the color toner images onto a transfer member, in which the vibration is prevented from acting on the photosensitive member during a latent image corresponding to each color image is formed, thereby improving the image quality. That is to say, when a peripheral length of the transfer member is $L_1$, a distance between a light illuminating position of the light information illuminating means on the photosensitive member and a transfer position of the transfer member is $L_2$, and a length of a maximum image formed on the transfer member is $L_3$, a relation $(L_1-L_3)>L_2$ is established, thereby preventing the vibration from acting on the photosensitive member.

8 Claims, 5 Drawing Sheets

COLOR IMAGE FORMING APPARATUS FOR FORMING COLOR IMAGE BY TRANSFERRING COLOR TONER TO TRANSFER MATERIAL

BACKGROUND OF THE INVENTION

1. Field of the Invention

The present invention relates to a color image forming apparatus of electrophotographic type such as a color copying machine, a color printer and the like.

2. Related Background Art

In some color image forming apparatuses, latent images corresponding to various color components are formed on an image bearing member and such latent images are developed by developer having colors corresponding to the latent images to obtain color toner images. Whenever each toner image is obtained, the toner image is transferred onto a transfer material held by a rotating transfer drum. By repeating such transferring operations by several times corresponding to the number of color toner images, a multi-color image is obtained. In this case, as shown in FIG. 5, by firmly assembling an electrophotographic photosensitive drum (image bearing member) 4*a* to a body 9 of the image forming apparatus with high accuracy, disarrangement or vibration of rotation of the photosensitive drum 4*a* is prevented, thereby obtaining the color image with higher quality.

Further, since the photosensitive drum 4*a* must have a relatively large diameter (at least a half of a diameter of a transfer drum 3) in order to improve the durability of the photosensitive drum 4*a*, the diameter of the photosensitive drum 4*a* was 50 mm or more.

However, in the conventional combination of the photosensitive drum 4*a* and the transfer drum 3, regarding a plurality of developing devices 5 (i.e., magenta developing device 5M, cyan developing device 5C, yellow developing device 5Y and black developing device 5K), after development for a certain color was finished, a mechanical switching operation for bringing the next developing device to the photosensitive drum 4*a* to perform development for a next color was effected before the previous transferring operation is completely finished. That is to say, it was designed so that a distance ($X_1$) between a latent image forming position (where image information light $\lambda$ is incident to a surface of the photosensitive drum 4*a* ) and a transfer position (where the photosensitive drum 4*a* is opposed to the transfer drum 3) becomes greater than a value obtained by subtracting a length ($X_3$) of the transfer material 2 wound around the transfer drum 3 from a peripheral length ($X_2$) of the transfer drum 3, that is, $(X_2-X_3)<X_1$. With this arrangement, unless the previous developing device is changed or switched to the next developing device during the transferring operation, the next latent image formation cannot be effected in time. Thus, since the developing devices were rotated during the transferring operation, vibration and/or shock were generated, thereby affecting a bad influence upon the image. Incidentally, in order to prevent such vibration, it is desirable to rotate the developing devices while the transfer drum is being rotated idly without the transferring of the image. In this case, however, the number of revolutions of the transfer drum was increased in accordance with the number of the color toner images, thereby increasing the image forming time.

SUMMARY OF THE INVENTION

An object of the present invention is to operate a color image forming apparatus efficiently and to improve image quality.

Another object of the present invention is to provide a color image forming apparatus for forming various color toner images by changing color developing devices with respect to an electrophotographic photosensitive member, wherein vibration generated during the change of the developing device is prevented from affecting a bad influence upon a latent image formation.

To achieve the above objects, a color image forming apparatus for forming a color image by transferring color toner to a transfer material, according to the present invention, comprises an electrophotographic photosensitive member shiftable endlessly, a color latent image forming means opposed to the photosensitive member and having a light information illuminating means corresponding to a color image to form electrostatic latent images corresponding to color toner images on the photosensitive member, a plurality of developing means adapted to be changed one by one with respect to the photosensitive member to develop the color latent images as color toner images, respectively, a transfer member shiftable endlessly in synchronous with the electrophotographic photosensitive member and adapted to hold a transfer material onto which the color toner images formed on the photosensitive member are successively transferred at a transfer position, and fixing means for fixing the toner image to the transfer material with heat. Wherein, when a peripheral length of the transfer member is $L_1$, a distance between the light information illuminating means of the color latent image forming means and the transfer position of the transfer member is $L_2$ and a length of a maximum image formed on the transfer member is $L_3$, a relation $(L_1-L_3)>L_2$ is established.

DETAILED DESCRIPTION OF THE PREFERRED EMBODIMENTS

Figure 1:
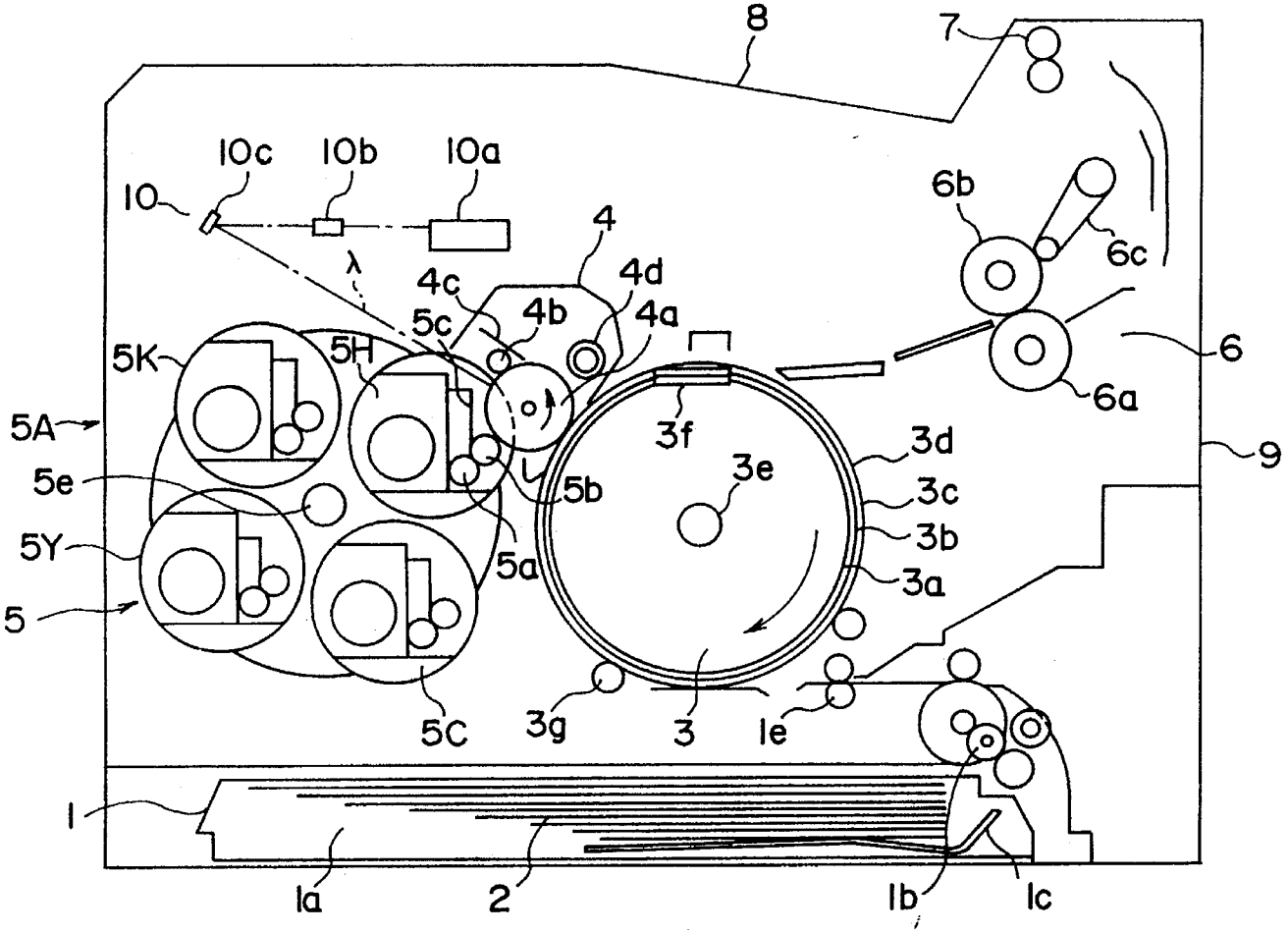
FIG. 1 is an elevational sectional view of a color image forming apparatus according to a preferred embodiment of the present invention.

FIG. 1 is an elevational sectional view of a color image forming apparatus (color laser beam printer) according to a preferred embodiment of the present invention. First of all, the entire construction of the image forming apparatus will be explained briefly.

As shown in FIG. 1, the color image forming apparatus according to this embodiment comprises an electrophotographic photosensitive belt (not shown) or drum 4*a* acting as an image bearing member. An electrostatic latent image for one color is formed on the photosensitive drum 4*a* by the exposure of the drum, and the latent image is then developed by a rotatable developing apparatus 5A to obtain a color toner image. The color toner image is transferred onto a transfer material 2 supplied from a sheet supply portion 1 and wound around a transfer drum (transfer member) 3. Meanwhile, a next latent image for another color is formed on the photosensitive drum, which latent image is developed as a toner image having another color. This toner image is transferred onto the same transfer material in a superposed fashion. By repeating such operations for all of colors, a full-color image is formed on the transfer material. The transfer material 2 to which all of the color toner images were transferred is separated from the transfer drum 3 and then is sent to a fixing portion 6, where the toner images are fused, mixed and fixed to the transfer material as a permanent full-color image. Then, the transfer material is discharged onto a discharge portion 8 disposed on the image forming apparatus.

The exposure of image information light on the photosensitive drum 4*a* is effected by a scanner portion 10. The scanner portion 10 has a laser diode (not shown). When an image signal is sent to the laser diode, the latter emits image light λ corresponding to the image signal, which image light is incident to a polygon mirror 10*a*. The polygon mirror 10*a* is rotated at a high speed by a scanner motor to reflect the image light λ. The image light λ reflected by the polygon mirror 10*a* line-scans the photosensitive drum 4*a* through an exposure portion of an image bearing member unit via a focusing lens 10*b* and a reflection mirror 10*c*, thereby selectively exposing the dot-shaped light information on the photosensitive drum.

Next, various elements of the image forming apparatus will be fully explained.

The sheet supply portion 1 serves to supply the transfer material 2 to the transfer drum 3, and has a sheet supply cassette 1*a* which is removably mounted to a lower portion of the body 9 of the image forming apparatus and which is adapted to contain a plurality of transfer materials 2. During the image forming operation, a sheet supply roller 1*b* is rotated in response to the image forming operation to separate the transfer materials 2 in the cassette 1*a* one by one and to supply the separated transfer material to the transfer drum 3. The transfer material 2 is guided by a guide plate 1*c* and is supplied to the transfer drum 3 through a pair of regist rollers 1*e*.

The tranfer material 2 sent to the transfer drum 3 is wound around the transfer drum. The transfer drum 3 is rotated in a clockwise direction (direction shown by the arrow in FIG. 1) at the same peripheral speed as that of the photosensitive drum 4*a* toward an image transfer position where the transfer drum is opposed to the photosensitive drum 4*a* to transfer the color toner image on the photosensitive drum 4*a* onto the transfer material 2. The transfer drum 3 is rotatably supported on a fixed shaft 3*e* and is rotated in the clockwise direction in response to the image forming operation by transmitting a driving force from a drive motor (not shown) to a gear (not shown) secured to the transfer drum 3.

In the illustrated embodiment, the transfer drum 3 comprises an aluminum cylinder 3*a* having a diameter of about 160 mm, an elastic layer 3*b* made of sponge, rubber or the like and coated on the aluminium cylinder, a resistance layer 3*c* coated on the elastic layer, and an outermost dielectric layer 3*d*.

Further, a gripper 3*f* for gripping a tip end of the transfer material 2 is provided at a predetermined position on a peripheral surface of the transfer drum 3. Further, an electrostatic absorb roller 3*g* is separably contacted with the peripheral surface of the transfer drum 3 so that the transfer material 2 is urged against the peripheral surface of the transfer drum 3 by the absorb roller 3*g*. By applying a voltage between the absorb roller 3*g* and the transfer drum 3, the charges are-created in the transfer material (dielectric material) 2 and in the dielectric layer 3*d* of the transfer drum 3, thereby electrostatically absorbing the transfer material 2 to the peripheral surface of the transfer drum 3. Incidentally, the method for absorbing the transfer material 2 to the transfer drum 3 is not limited to the above-mentioned electrostatic absorbing method, but the transfer material may be absorbed to the transfer drum by air suction.

In the illustrated embodiment, the photosensitive drum (image bearing member) 4*a* comprises an aluminum cylinder having a diameter of about 40 mm and an organic photo-conductive layer coated on an peripheral surface of the cylinder, and a rotary shaft of the drum is rotatably supported by a cover 4 of the image bearing member unit. The photosensitive drum 4*a* is rotated in a clockwise direction in response to the image forming operation by transmitting a driving force of a drive motor (not shown) to one end of the rotary shaft of the drum. A charger 4*b* and a cleaner 4*c* are arranged around the photosensitive drum 4*a* . The image bearing member unit including the photosensitive drum 4*a*, charger 4*b* and the like can be removably mounted to the image forming apparatus so that it can easily be exchanged by a new one when a service life of the photosensitive drum 4*a* is expired.

The charger 4*b* is of a so-called contact charging type as disclosed in the Japanese Patent Laid-open Application No. 63-149669 (corresponding to U.S. Pat. No. 4,851,960) and has a conductive roller which is contacted with the photosensitive drum 4*a*. By applying a voltage to the conductive roller, the surface of the photosensitive drum 4*a* is uniformly charged.

Further, the cleaner 4*c* serves to remove the residual toner remaining on the photosensitive drum 4*a* after the toner image formed on the photosensitive drum 4*a* by the developing apparatus 5A was transferred to the transfer material 2. In the illustrated embodiment, waste toner removed by the cleaner 4*c* is conveyed into a waste toner container (not shown) attached to the image forming apparatus by means of a convey screw 4*d* arranged in the waste toner container. When the waste toner container is filled by the toner, it is dismounted from the image forming apparatus and a new waste toner container is mounted.

The rotatable developing apparatus 5A includes developing devices 5M, 5C, 5Y and 5K containing magenta toner, cyan toner, yellow toner and black toner, respectively. These four color developing devices 5 are arranged for rotational movement around a shaft 5*e*. The developing devices 5 have rotation gears disposed around and meshed with a revolution gear so that the developing devices are rotated with keeping their postures in predetermined orientation.

In the image forming operation, the developing devices 5 are rotated around the shaft 5*e* until the developing device corresponding to the latent image is brought to a developing position opposed to the photosensitive drum 4*a*. Then, at the developing position, after a developing sleeve 5*b* of the developing device 5 is positioned to face the photosensitive drum 4*a* with a small gap (about 300 μm) therebetween, the latent image formed on the photosensitive drum 4*a* is developed by the color toner contained in a developing container of the developing device. In the developing device 5 now effecting the development, the toner is sent to a coating roller 5*a* by a feed mechanism disposed in the toner container. While the toner is being supplied to the developing sleeve 5*b* by the rotation of the coating roller 5*a*, a thin toner layer is formed on the developing sleeve 5b, and a thickness of the toner layer is regulated by a blade 5c. At the same time, frictional charge is applied to the toner layer.

In the developing operation, developing bias is applied between the developing sleeve 5b and the photosensitive drum 4a, so that the toner on the developing sleeve 5b is immigrated to the latent image on the photosensitive drum 4a, thereby visualizing the latent image as the color toner image. When the developing device 5 is rotatingly shifted to the developing position, the developing sleeve 5b of the developing device 5 is connected to a corresponding high voltage source, thereby applying developing voltage bias selected for each color to the developing sleeve 5b.

As shown in FIG. 1, the fixing portion 6 includes a drive pressure roller 6a, and a fixing roller 6b abutted against the pressure roller and adapted to apply heat and pressure to the transfer material 2. The transfer material 2 separated from the transfer drum 3 and sent to the fixing portion 6 is passed through the fixing portion 6 by a conveying force of the pressure roller 6a, during which the color toner images on the transfer material 2 are fixed to the transfer material with heat and pressure. Incidentally, a cleaning member 6c is contacted with the fixing roller 6b so that the toner adhered to the fixing roller 6b is removed by the cleaning member 6c.

Next, the image forming operation of the image forming apparatus having the above-mentioned construction will be explained. The sheet supply roller 1b shown in FIG. 1 is rotated to separate one transfer material 2 from the sheet supply cassette 1a and to send the separated transfer material to the transfer drum 3. The transfer drum 3 is rotated in the clockwise direction in FIG. 1 to grip the tip end of the transfer material 2 by the gripper 3f and to electrostatically adhere the transfer material around the peripheral surface of the transfer drum.

The image bearing member 4a is rotated in the clockwise direction in synchronous with the rotation of the transfer drum 3. The surface of the image bearing member 4a is uniformly charged by the charger 4b and then the image light λ for magenta color image is incident to the image bearing member 4a by the scanner portion 10, thereby forming a latent image corresponding to the magenta color image on the image bearing member 4a. At the same time as the latent image formation, the magenta developing device 5M is driven to apply the developing bias voltage having the same charging polarity and potential as those of the image bearing member 4a, with the result that the magenta color toner is adhered to the latent image formed on the image bearing member 4a, thereby forming the magenta color toner image on the image bearing member 4a. Then, by applying the transfer voltage having the polarity opposite to that of the magenta color toner to the transfer drum 3 via its shaft 3e, the magenta color toner image on the image bearing member 4a is transferred onto the transfer material 2 on the transfer drum 3.

After the magenta color toner image was transferred to the transfer material, the next developing device is rotated to reach the developing position opposed to the photosensitive drum (image bearing member) 4a. Similarly, latent images corresponding to cyan, yellow and black color images are formed and developed as different color toner images which are successively transferred onto the same transfer material 2 in a superposed fashion, thereby obtaining a full-color image on the transfer material 2. The transfer material 2 to which the toner images were transferred is separated from the transfer drum 3 and then is sent to the fixing portion 6, where the toner images are fixed to the transfer material. Thereafter, the transfer material 2 is discharged onto the discharge tray 8 by the pair of discharge rollers 7. In this way, the image forming operation is finished.

Figure 2:
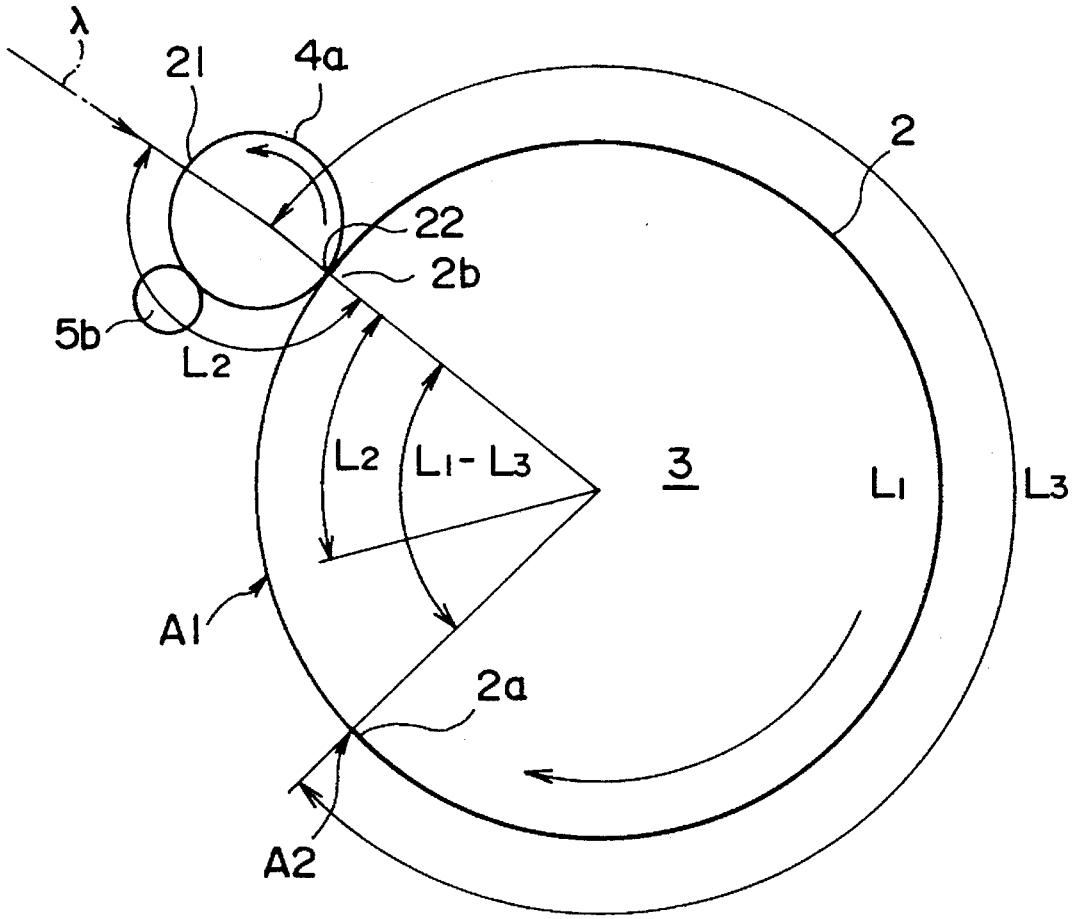
FIG. 2 is an explanatory view for showing a relation between lengths of a photosensitive drum, a transfer drum and a transfer material in the color image forming apparatus of FIG. 1.

In the illustrated embodiment, as shown in FIG. 2, a dimensional relation between a distance $L_2$ (between the latent image forming position (image light λ incident position) 21 on the photosensitive drum 4a and the toner image transfer position (where the photosensitive drum 4a is opposed to the transfer drum) 22), a peripheral length $L_1$ of the transfer drum 3, and a maximum length $L_3$ of an available transfer material 2 is selected to be $(L_1—L_3)>L_2$. With this arrangement, as shown in FIG. 2, in a condition that the toner image for each color has just been transferred to the transfer material, a trailing end 2b of the transfer material 2 wound around the transfer drum 3 is in a position opposed to the photosensitive drum 4a, and a tip end 2a of the transfer material is in a position A2 disposed at an upstream side of a position A1 spaced apart from the opposing position (where the photosensitive drum 4a is opposed to the transfer drum 3) by a distance $L_2$, which position A1 corresponds to a timing position for a next latent image formation.

Figure 3:
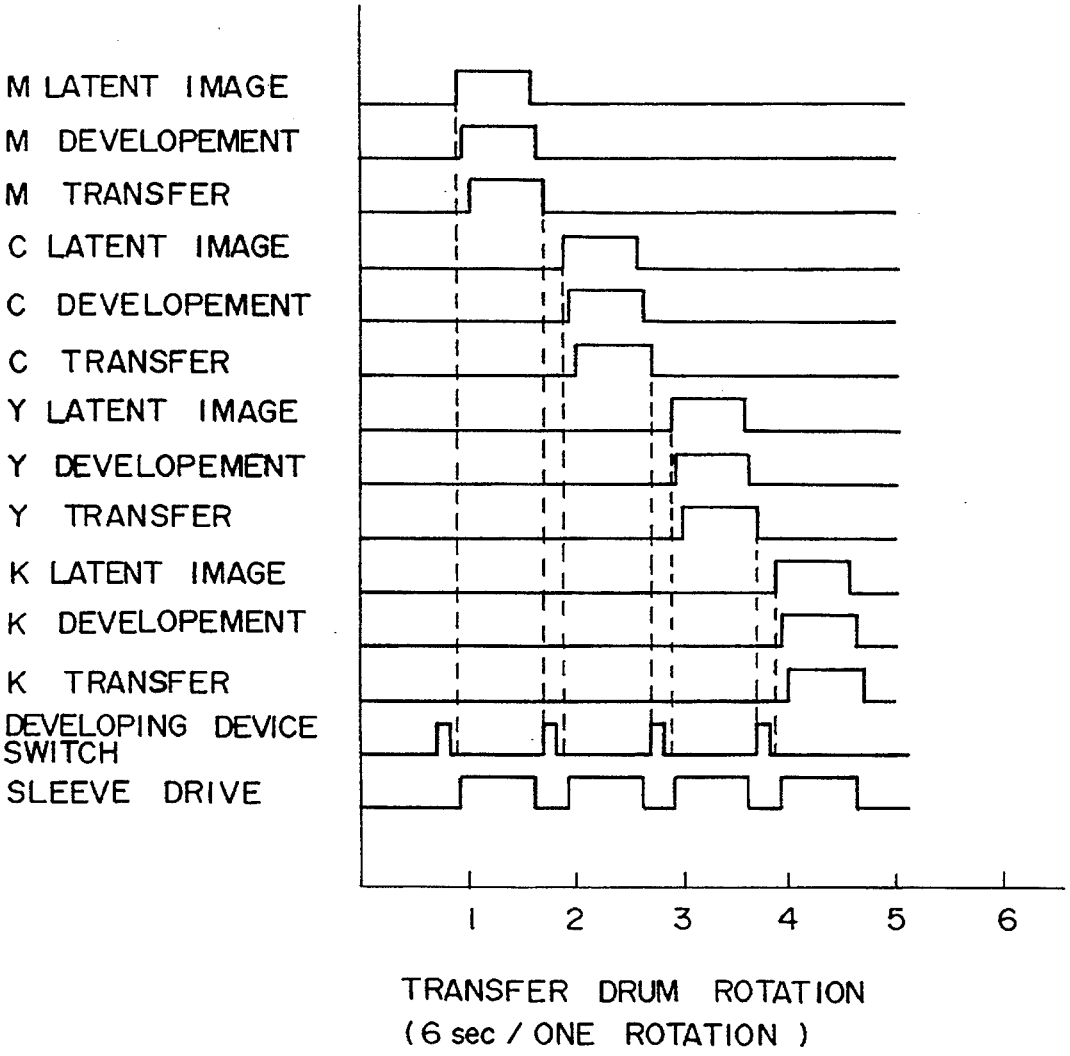
FIG. 3 is a timing chart showing an image formation sequence in the color image forming apparatus of FIG. 1.

Accordingly, the next developing device 5 can be rotated to and positioned in the developing position during the tip end of the transfer material 2 is being moved from the position A2 to the position A1, and, thus, as shown in FIG. 3 showing a timing chart of the image formation sequence, regarding all of colors, the latent image formation, development and transferring can be performed under the same condition without affecting the mechanical influence of the switching of the developing device upon the image forming operation. According to the image formation sequence shown in FIG. 3, the developing device switching operation is effected between the end of the transferring of each color toner image and the start of the next latent image formation. In FIG. 3, "M" indicates magenta color, "C" indicates cyan color, "Y" indicates yellow color, and "K" indicates black color.

In particular, by changing the developing device within a time period from the end of the transferring to the start of the next exposure, i.e., a time period during which the transfer drum is rotated by an amount of $(L_1-L_3)-L_2$, the transfer operation and the latent image formation are not badly influenced upon the vibration due to the switching of the developing device. Incidentally, the time period required for changing the developing device may be 1000 msec to 300 msec and is generally 400 msec.

In the illustrated embodiment, while an example that the full-color image is formed from four colors, i.e., magenta, cyan, yellow and black was explained, the present invention is not limited to this example, but the full-color image may be formed from three colors, for example, magenta, cyan and yellow. Further, not only the full-color image but also a multi-color image (such as two-color image or three-color image without mixing colors) may be formed by the present invention.

Further, a developing method may be a conventional two-component magnet brush developing method, cascade developing method, touch-down developing method, cloud developing method or the like.

Figure 4:
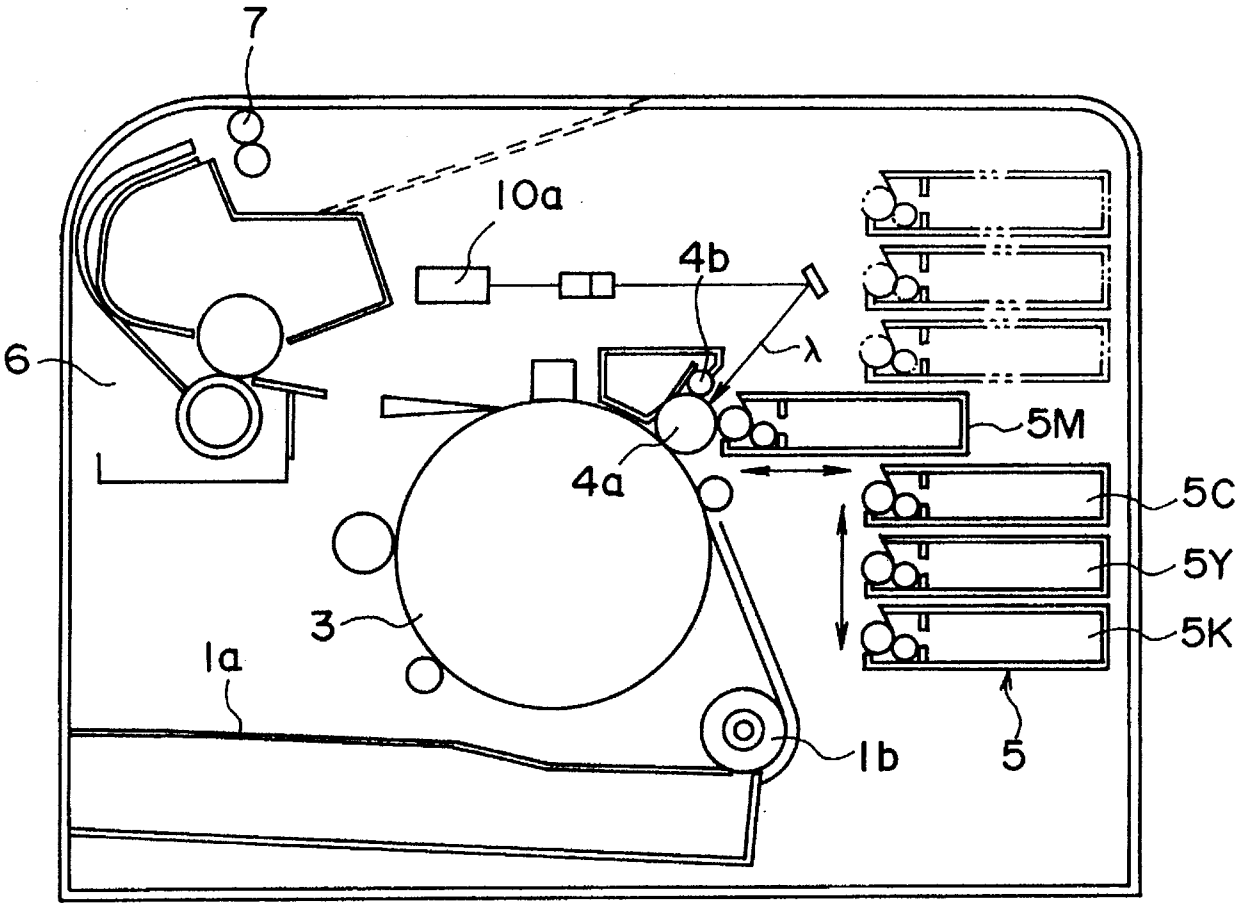
FIG. 4 is an elevational sectional view of a color image forming apparatus according to another embodiment of the present invention.
Figure 5:
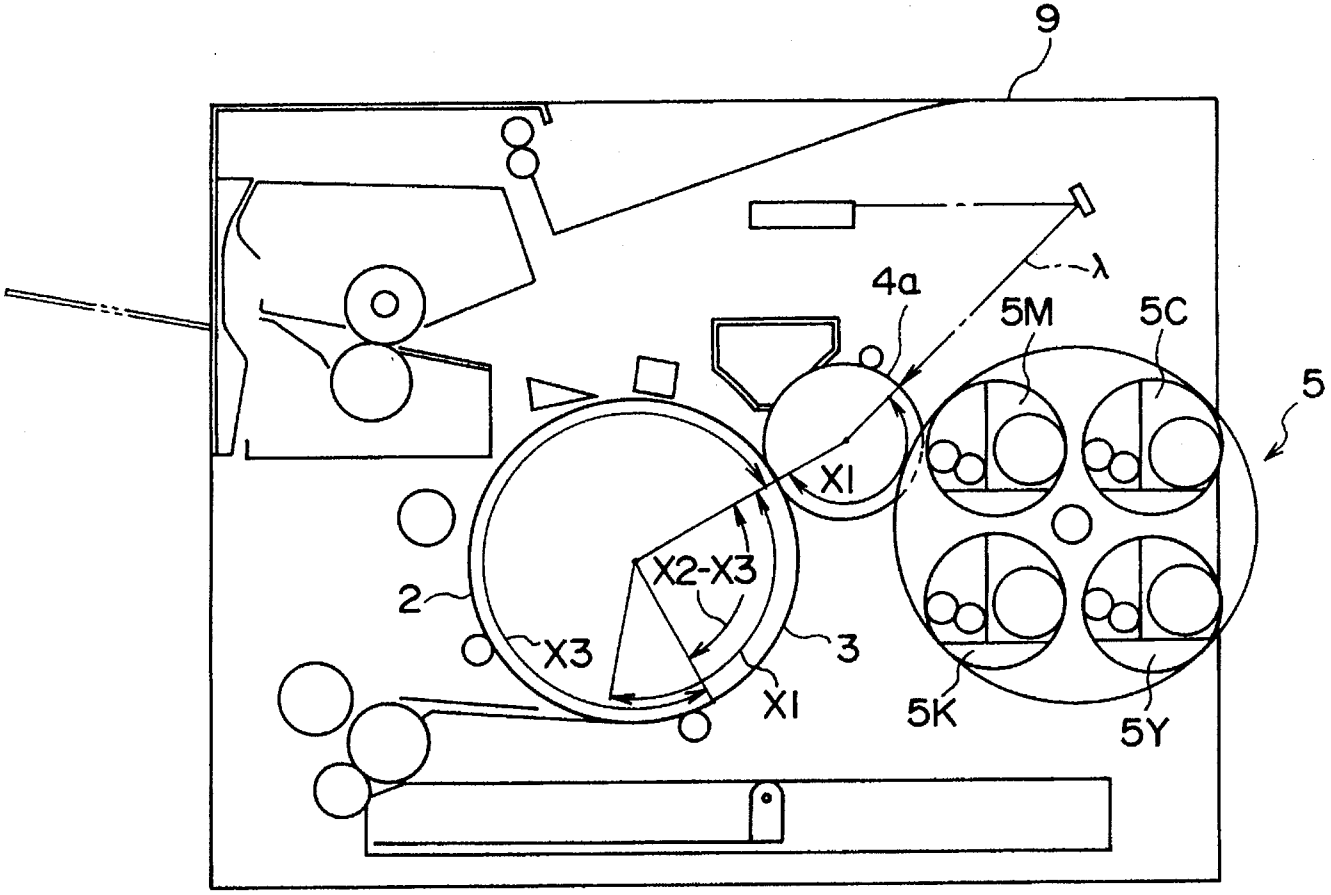
FIG. 5 PRIOR ART
FIG. 5 is an elevational sectional view of a conventional color image forming apparatus.

Furthermore, as shown in FIG. 4, the developing devices 5M, 5C, 5Y, 5K may be arranged in a line along a vertical direction and may be shifted in a vertical direction to be selectively brought to the developing position opposed to the photosensitive drum 4a, or the developing devices may be arranged in a line along a horizontal direction and may be shifted in a horizontal direction to be selectively brought to the developing position opposed to the photosensitive drum 4*a*.

Incidentally, as well as the above-mentioned transfer drum of the type wherein the transfer material is born on the drum, a transfer drum onto which color toner images are directly transferred may be used, and then the toner images may be collectively transferred onto a transfer material.

Further, in the latent image forming means for forming the line-shaped latent image by the optical system such as the laser or other digital optical system such as an LED or the like, the present invention is particularly effective to prevent the pitch irregularity (distances between the adjacent scanning lines are not constant to generate a shade of color in the image). In addition, the transfer member may be a transfer belt, as well as the transfer drum.

As mentioned above, in the color image forming apparatus according to the present invention, since the relation between the distance $L_2$ (between the latent image forming position on the image bearing member and the transfer position), peripheral length $L_1$ of the transfer member and length $L_3$ of the maximum transfer material capable of being wound around the transfer member is selected to be $(L_1-L_3)>L_2$, the image forming operations for various colors can be effected independently from the developing device changing operation generating the mechanical vibration, thereby obtaining the color image with higher quality. Further, the image bearing member can be made small-sized, thus making the entire image forming apparatus compact and facilitating the handling of the image bearing member unit. In addition, since the transfer member is not required to be rotated idly between the transferring operations for changing the developing device, the time for obtaining the complete color image can be reduced.

What is claimed is:

1. An image forming apparatus comprising:

a rotary photosensitive member;

charge means for charging said photosensitive member;

exposure means for image-exposing said photosensitive member charged by said charge means at an exposure station to thereby form an electrostatic image;

a plurality of developing device for developing the electrostatic image on said photosensitive member;

changing means for changing said developing devices to be used for developing the electrostatic image; and a transfer rotary member onto which the developing image on said photosensitive member is transferred at a transfer station;

wherein defining a peripheral length of said transfer rotary member is $L_1$, a distance between the exposure station and the transfer station is $L_2$, and a maximum transfer length in a moving direction of said photosensitive member is $L_3$, the relation of $(L_1-L_3)>L_2$ is established; and said changing means changes said developing devices between a completion of the transferring and start of a next image exposure.

2. An image forming apparatus according to claim 1, wherein said transfer rotary member bears a transfer material on a peripheral surface thereof onto which transfer material the developing image is transferred.

3. An image forming apparatus according to claim 2, wherein the maximum transfer length $L_3$ is equal to a length of transfer material of maximum size.

4. An image forming apparatus according to claim 1, wherein said plurality of developing devices includes a yellow toner, a magenta developing device for containing a magenta toner, and a cyan developing device for containing a cyan toner, for accumulating the yellow toner image, magenta toner image and cyan toner image.

5. An image forming apparatus according to claim 4, further comprising color mixing means for forming a full color image by mixing the yellow toner, magenta toner and cyan toner.

6. An image forming apparatus according to claim 1, wherein said changing means includes a supporting member for supporting said plurality of developing devices, and a drive member for driving them.

7. An image forming apparatus according to claim 1, wherein said exposure means exposes said photosensitive member by a beam modulated corresponding to an image signal.

8. An image forming apparatus according to claim 7, wherein the beam is a laser beam.

* * * * *

UNITED STATES PATENT AND TRADEMARK OFFICE

CERTIFICATE OF CORRECTION

PATENT NO. : 5,486,902
DATED : January 23, 1996
INVENTOR(S) : AKIRA ITO

It is certified that error appears in the above-indentified patent and that said Letters Patent is hereby corrected as shown below:

ON THE TITLE PAGE:

Item [56] RC,

Line "5,683,167 1/1992 Fukushima et al." should read --5,083,167 1/1992 Fukushima et al.--.

Column 4, line 3, "are-created" should read --are created--;
line 21, "4a" should read --4a.--; and
line 22, "." should be deleted.

Column 7, line 43, "device" should read --devices--.

Signed and Sealed this

Ninth Day of July, 1996

Bruce Lehman

*Attest:*

BRUCE LEHMAN

*Attesting Officer*

*Commissioner of Patents and Trademarks*